US010031470B2

(12) United States Patent
Mizutani et al.

(10) Patent No.: US 10,031,470 B2
(45) Date of Patent: Jul. 24, 2018

(54) DEVELOPER CONTAINER THAT REDUCES COMING-OFF OF ROTATING MEMBER AND IMAGE FORMING APPARATUS THAT INCLUDES THE SAME

(71) Applicant: Kyocera Document Solutions Inc., Osaka (JP)

(72) Inventors: Naoki Mizutani, Osaka (JP); Akinari Takahashi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/821,909

(22) Filed: Nov. 24, 2017

(65) Prior Publication Data

US 2018/0143583 A1 May 24, 2018

(30) Foreign Application Priority Data

Nov. 24, 2016 (JP) ..... 2016-227620

(51) Int. Cl.
*G03G 15/08* (2006.01)
*G03G 21/16* (2006.01)

(52) U.S. Cl.
CPC ..... *G03G 21/1647* (2013.01); *G03G 15/0891* (2013.01); *G03G 21/1676* (2013.01)

(58) Field of Classification Search
CPC ..... G03G 21/1647; G03G 15/0891; G03G 21/1676
USPC ..... 399/119
See application file for complete search history.

(56) References Cited

U.S. PATENT DOCUMENTS

2016/0202660 A1* 7/2016 Terai ..... G03G 21/1647 399/110

FOREIGN PATENT DOCUMENTS

JP H08-062957 A 3/1996

* cited by examiner

*Primary Examiner* — Susan Lee
(74) *Attorney, Agent, or Firm* — James Judge

(57) ABSTRACT

A developer container includes a container body, a rotating member, and a position regulating portion. The rotating member includes both end portions in axial direction rotatably supported by a pair of sidewalls. The position regulating portion is located in the container body so as to cover a part of the rotating member. The rotating member includes a large-diameter portion and a small-diameter portion. The large-diameter portion is formed to have an outer diameter rotatable around a shaft inside the position regulating portion. The small-diameter portion is formed to have an outer diameter smaller than the large-diameter portion. The position regulating portion includes a cut-out portion that regulates passing of the large-diameter portion and permits passing of the small-diameter portion. The small-diameter portion is arranged by being displaced in the axial direction from an inside of the position regulating portion, and the large-diameter portion is arranged inside the position regulating portion.

9 Claims, 14 Drawing Sheets

DEVELOPER CONTAINER THAT REDUCES COMING-OFF OF ROTATING MEMBER AND IMAGE FORMING APPARATUS THAT INCLUDES THE SAME

INCORPORATION BY REFERENCE

This application is based upon, and claims the benefit of priority from, corresponding Japanese Patent Application No. 2016-227620 filed in the Japan Patent Office on Nov. 24, 2016, the entire contents of which are incorporated herein by reference.

BACKGROUND

Unless otherwise indicated herein, the description in this section is not prior art to the claims in this application and is not admitted to be prior art by inclusion in this section.

A typical image forming apparatus includes a developing device that develops an electrostatic latent image on an image carrier to make a toner image. A developer is housed in a developer container to be supplied to the developing device from the developer container.

There is proposed a developer-circulation-stirring device that includes a spiral roll conveying toner inside a developing container. A shaft of the spiral roll passes through a partition wall formed at the center in an axial direction of the developing container. Both the end portions of the shaft are rotatably supported by a pair of sidewalls of the developing container. The partition wall is located to divide a conveyance path of toner to right and left.

SUMMARY

A developer container according to one aspect of the disclosure includes a container body, a rotating member, and a position regulating portion. The container body includes an internal space and a pair of sidewalls. The internal space houses a developer. The pair of sidewalls are opposed across the internal space. The rotating member includes both end portions in an axial direction of the rotating member. Both the end portions are rotatably supported by the pair of sidewalls. The position regulating portion is located in the container body so as to cover a part of the rotating member. The rotating member includes a large-diameter portion and a small-diameter portion. The large-diameter portion is formed to have an outer diameter rotatable around a shaft inside the position regulating portion. The small-diameter portion is formed to have an outer diameter smaller than the large-diameter portion. The position regulating portion includes a cut-out portion that regulates passing of the large-diameter portion and permits passing of the small-diameter portion. The small-diameter portion is arranged by being displaced in the axial direction from an inside of the position regulating portion, and the large-diameter portion is arranged inside the position regulating portion.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
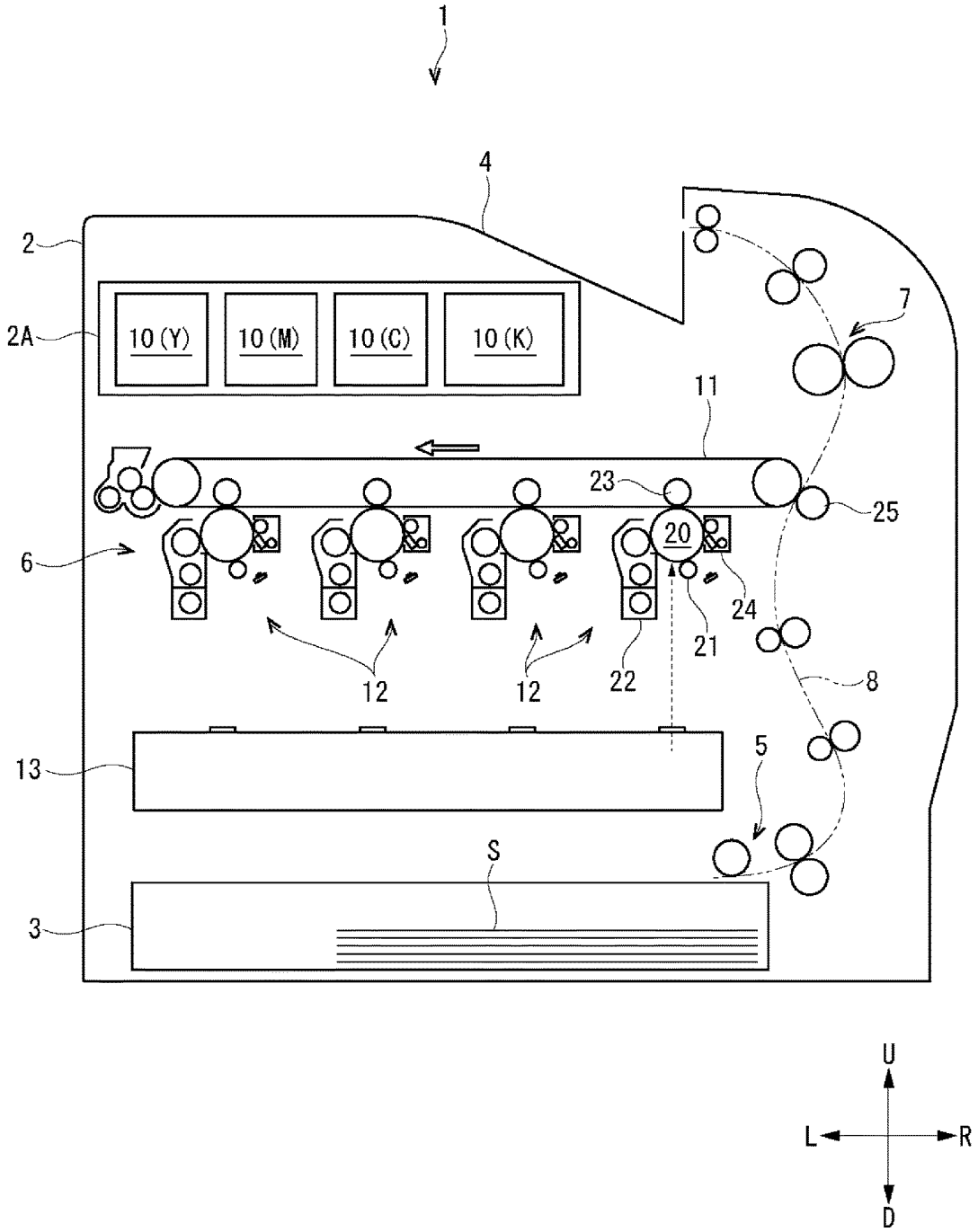
FIG. 1 illustrates a front view schematically illustrating an internal structure of a color printer according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes preferred embodiments of the disclosure with reference to the accompany drawings. A paper-surface front in FIG. 1 is a front surface, and as illustrated in the respective drawings, "Fr" indicates a "front," "Rr" indicates a "rear," "L" indicates the "left," "R" indicates the "right," "U" indicates an "up," and "D" indicates a "down."

Overall Configuration of Image Forming Apparatus

A description will be given of an overall configuration of a color printer 1 as one example of the image forming apparatus with reference to FIG. 1. FIG. 1 illustrates a front view schematically illustrating an internal structure of the color printer 1.

The color printer 1 includes an apparatus main body 2 that constitutes an approximately rectangular-shaped external appearance. In an internal lower side of the apparatus main body 2, a sheet feed cassette 3 housing a (bundle of) sheet S is removably located. On a top surface of the apparatus main body 2, a sheet discharge tray 4 is located. The sheet S includes a resin sheet and similar sheet, and is not limited to a paper sheet.

The color printer 1 includes a paper sheet feeder 5, an image forming unit 6, and a fixing unit 7, inside the apparatus main body 2. The paper sheet feeder 5 is located at an upstream end portion of a conveyance path 8 that extends from the sheet feed cassette 3 up to the sheet discharge tray 4. The fixing unit 7 is located on a downstream side of the conveyance path 8, and the image forming unit 6 is located between the paper sheet feeder 5 and the fixing unit 7 in the conveyance path 8.

The image forming unit 6 includes four toner containers 10, an intermediate transfer belt 11, four drum units 12, and a light scanning device 13. The four toner containers 10 are located side by side in a lateral direction below the sheet discharge tray 4. The intermediate transfer belt 11 is rotatably located below the respective toner containers 10. The four drum units 12 are located side by side in the lateral direction below the intermediate transfer belt 11. The light scanning device 13 is located below the respective drum units 12.

The four toner containers 10 house four-color (yellow, magenta, cyan, and black) toners (developers). The four drum units 12, which correspond to the four-color toners, each include a photoreceptor drum 20, a charging apparatus 21, a developing device 22, a primary transfer roller 23, and a cleaning apparatus 24. The toner may be a one-component developer made of a magnetic toner, or may be a two-component developer that contains a toner and a carrier.

The respective photoreceptor drums 20 contact on a lower surface of the intermediate transfer belt 11. The respective charging apparatuses 21 charge the surfaces of the respective photoreceptor drums 20. The respective photoreceptor drums 20 receive a scanning light emitted from the light scanning device 13 to carry an electrostatic latent image. The respective developing devices 22 develop the electrostatic latent images on the surfaces of the respective photoreceptor drums 20 to make toner images by using the toner supplied from the respective toner containers 10. The respective primary transfer rollers 23 primarily transfer the toner images on the respective photoreceptor drums 20 to the rotating intermediate transfer belt 11 in a sequential order. On the intermediate transfer belt 11, a full-color toner image is formed by superimposition of the four-color toner images. A secondary transfer roller 25 contacts the right side of the intermediate transfer belt 11 to form a secondary-transfer nip. The sheet S is sent out from the sheet feed cassette 3 to the conveyance path 8 by the paper sheet feeder 5. The full-color toner image is fixed to the sheet S by passing through the fixing unit 7 after undergoing secondary transfer on the sheet S that passes through the secondary-transfer nip. Then, the sheet S is discharged to the sheet discharge tray 4. The respective cleaning apparatuses 24 remove the toner remaining on the respective photoreceptor drums 20 after the transfer.

Detail Configuration of Toner Container

Figure 2:
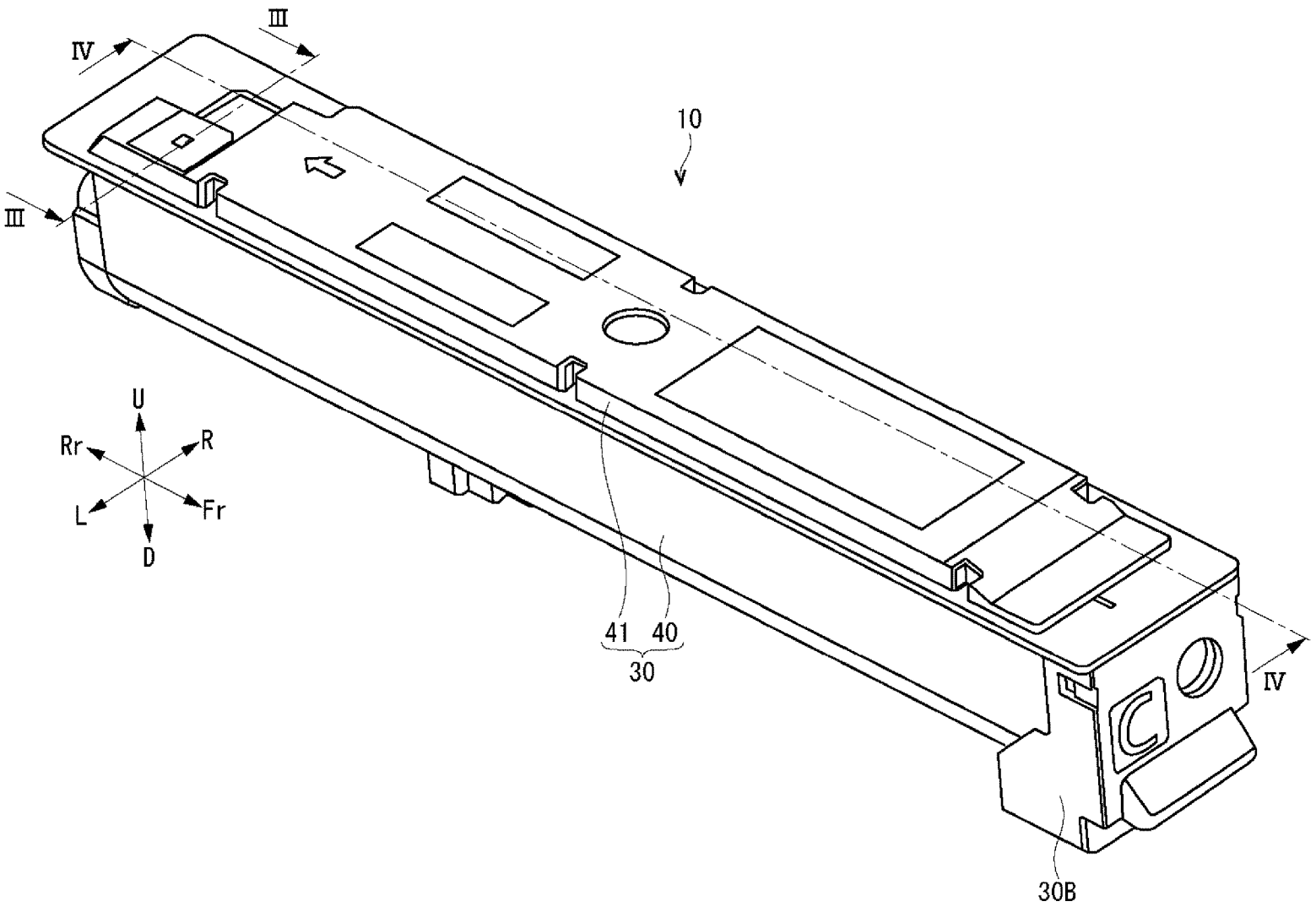
FIG. 2 obliquely illustrates a toner container according to the one embodiment.
Figure 3:
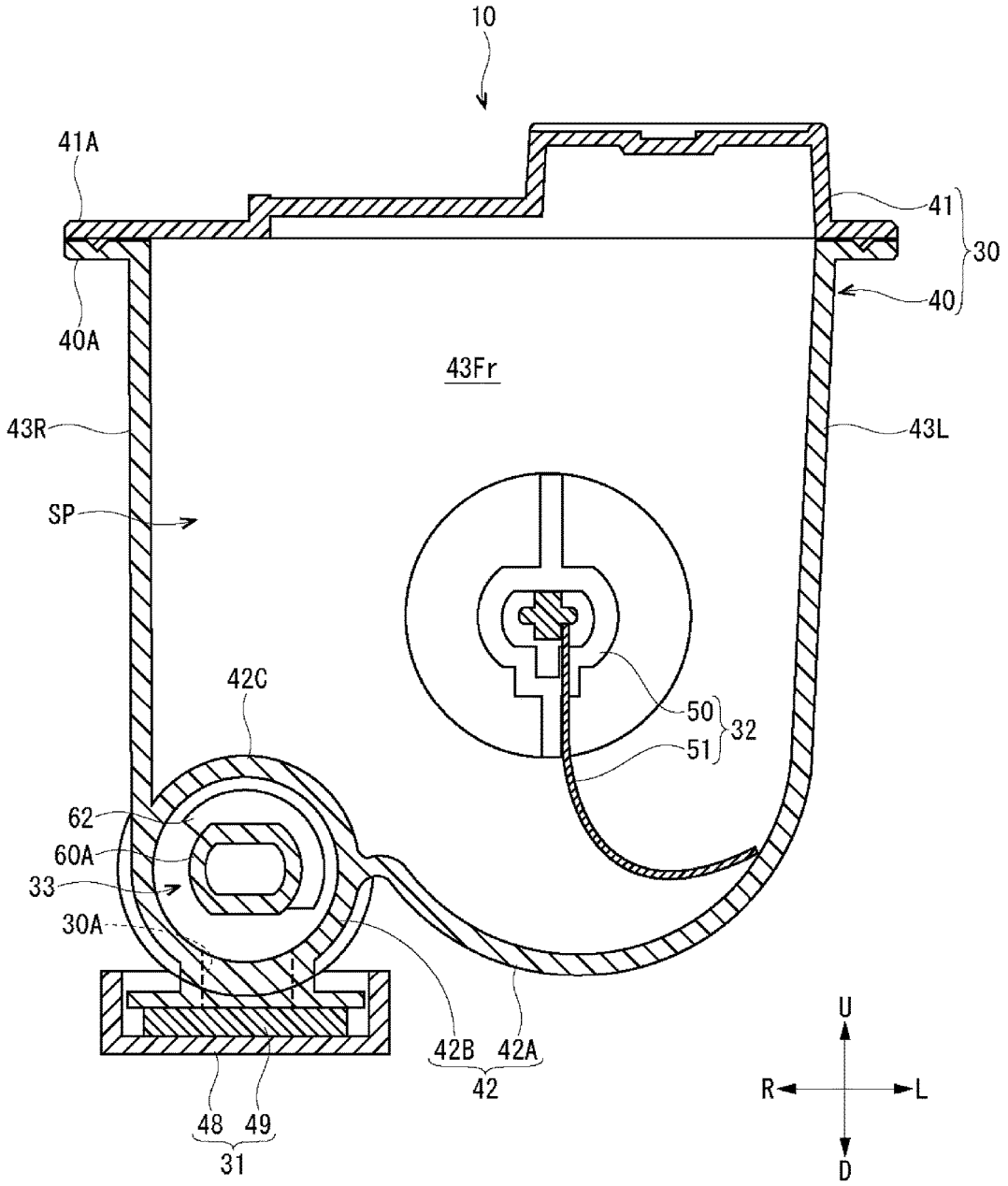
FIG. 3 illustrates a cross-sectional view taken along the III-III line in FIG. 2.
Figure 4:
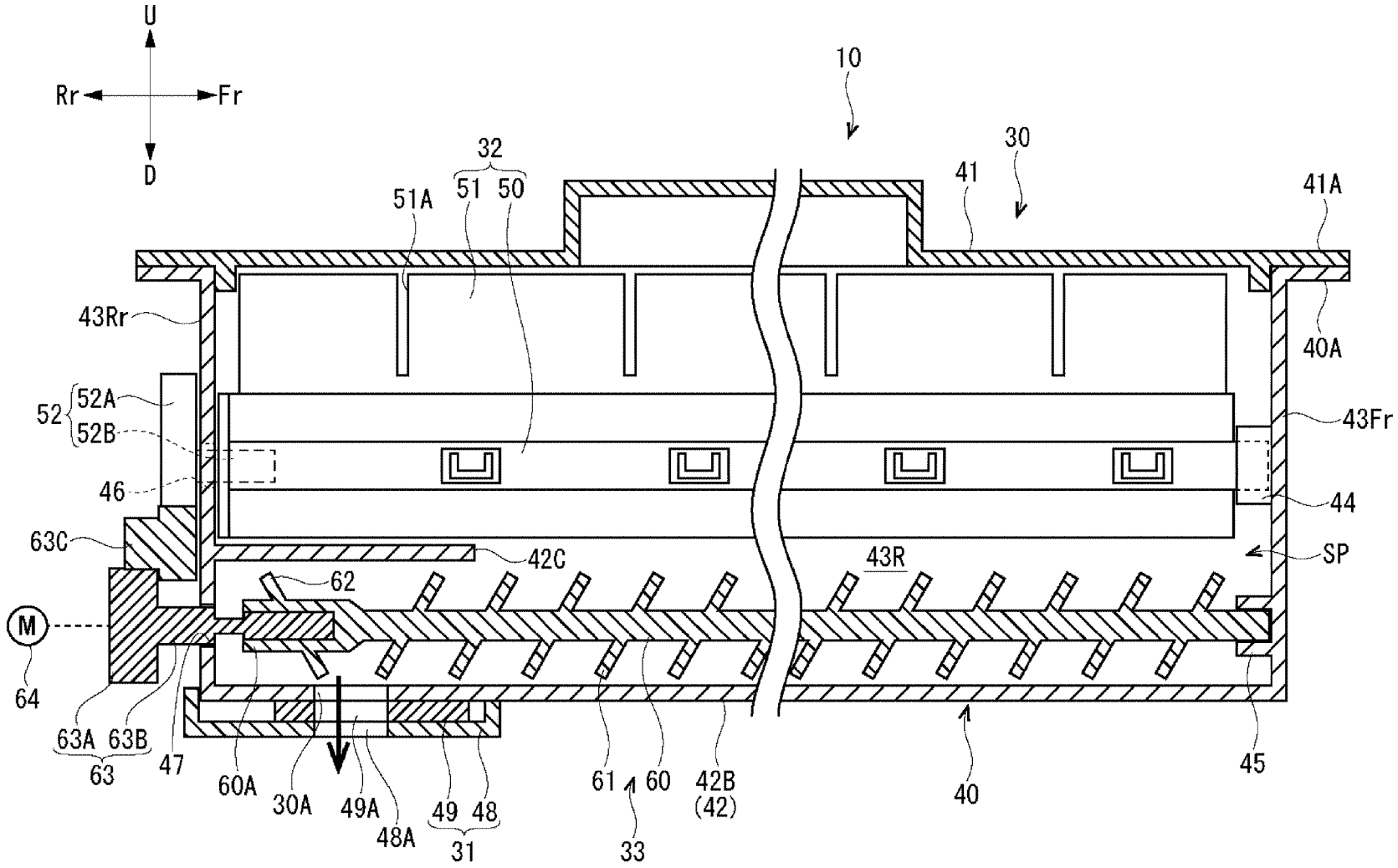
FIG. 4 illustrates a cross-sectional view taken along the IV-IV line in FIG. 2.

Next, by referring to FIGS. 1 to 4, a description will be given of the toner container 10 as one example of a developer container. FIG. 2 obliquely illustrates the toner container 10. FIG. 3 illustrates a cross-sectional view taken along the III-III line in FIG. 2. FIG. 4 illustrates a cross-sectional view taken along the IV-IV line in FIG. 2.

As illustrated in FIG. 1, on an upper portion of the apparatus main body 2, a mounting portion 2A for mounting the four toner containers 10 side by side in the lateral direction is located. The mounting portion 2A slidably supports the respective toner containers 10 in a front-rear direction. A user opens an opening/closing cover (not illustrated) located on the front surface of the apparatus main body 2 to perform a replacement work of the respective toner containers 10.

The toner container 10 that houses a black toner is formed to have a capacity larger than the other three toner containers 10, and the other three toner containers 10 are formed to have an identical capacity. While the capacities are different as described above, a basic configuration of the four toner containers 10 is similar, and thus, a description will be given of the toner container 10 that houses a toner of cyan (C).

As illustrated in FIGS. 2 to 4, the toner container 10 includes a container body 30, a shutter mechanism 31, a stirring member 32, and a transport screw 33. The container body 30 houses the toner. The shutter mechanism 31 is a mechanism that opens and closes a discharge port 30A of the container body 30. The stirring member 32 is a member for stirring the toner housed in the container body 30. The transport screw 33 as one example of a rotating member is a member for conveying the toner housed in the container body 30 to the discharge port 30A.

Configuration of Container Body

As illustrated in FIG. 2, the container body 30 is, for example, formed in an approximately rectangular parallelepiped shape long in the front-rear direction using a synthetic resin material. The container body 30 includes a lid portion 41 that closes a top-surface opening of a storage unit 40 having an approximately bathtub shape. On a front face of the container body 30, a cover 30B with a handle is mounted. Inside the container body 30, a storage space SP (an internal space) for storing the toner is formed (see FIG. 3).

As illustrated in FIGS. 3 and 4, the storage unit 40 includes sidewalls 43Fr, 43Rr, 43L, and 43R located upright on four sides of a bottom portion 42. On upper-end portions of the sidewalls 43Fr, 43Rr, 43L, and 43R, a flange 40A is formed. The bottom portion 42 includes a stir concave portion 42A and a conveyance concave portion 42B that are curved to become convex downward. The stir concave portion 42A is formed on the left side of the conveyance concave portion 42B viewed from a back surface (front surface) and is formed to be larger than the conveyance concave portion 42B in the lateral direction (see FIG. 3). In the back portion of the conveyance concave portion 42B, the discharge port 30A is opened. On a rear-portion top surface of the conveyance concave portion 42B, an approximately half-cylindrically-shaped tubular portion 42C is formed so as to cover the discharge port 30A. The rear portion of the conveyance concave portion 42B is covered by the tubular portion 42C to be formed in an approximately cylindrical shape.

As illustrated in FIG. 4, a stir bearing portion 44 and a conveyance bearing portion 45 protrude from an inner surface of the front-side sidewall 43Fr. The stir bearing portion 44 and the conveyance bearing portion 45 each are formed in an approximately cylindrical shape. The stir bearing portion 44 is located in a proximity of a center of a curvature of the stir concave portion 42A in the sidewall 43Fr. The conveyance bearing portion 45 is located in the proximity of the center of a curvature of the conveyance concave portion 42B in the sidewall 43Fr. On the other hand, in the rear-side sidewall 43Rr, a circular-shaped stir supporting hole 46 and a circular-shaped conveyance supporting hole 47 are opened. The stir supporting hole 46 is formed in the proximity of the center of the curvature of the stir concave portion 42A in the sidewall 43Rr. The conveyance supporting hole 47 is formed in the proximity of the center of the curvature of the conveyance concave portion 42B in the sidewall 43Rr.

As illustrated in FIGS. 3 and 4, in a lower end portion of the lid portion 41, a lid-side flange 41A opposed to the flange 40A of the storage unit 40 is formed. The lid portion 41 is secured to the storage unit 40 by joining of both the flanges 40A and 41A. In this state, the top-surface opening of the storage unit 40 is sealed by the lid portion 41.

Configuration and Action of Shutter Mechanism

As illustrated in FIGS. 3 and 4, the shutter mechanism 31 includes a shutter 49 that is slidably held inside a shutter holding portion 48. The shutter holding portion 48 is located in a lower surface of the conveyance concave portion 42B so as to cover the discharge port 30A. The shutter holding portion 48 has a first communication hole 48A that is opened and communicable with the discharge port 30A. The shutter 49 is formed in an approximately rectangular-plate shape. A second communication hole 49A is formed in the shutter 49.

The shutter 49 is slidably located between a release position (see FIG. 4), which causes the second communication hole 49A to align the discharge port 30A and the first communication hole 48A, and a close position, which causes the second communication hole 49A to be displaced from the discharge port 30A and the first communication hole 48A. When the toner container 10 is removed from the mounting portion 2A, the shutter 49 is biased by a biasing member (not illustrated) to be held at the close position. This ensures prevention of the toner leakage. On the other hand, in a process of mounting the toner container 10 to the mounting portion 2A, the shutter 49 engages with an engaging portion (not illustrated) located in the mounting portion 2A to slide from the close position to the release position. This ensures communication of the toner container 10 and the developing device 22 via a toner conveyance path (not illustrated) and replenishment of the toner inside the container body 30 to the developing device 22.

Configuration of Stirring Member

As illustrated in FIGS. 3 and 4, the stirring member 32 includes a stir rotation shaft 50 and a stirring blade 51. The stir rotation shaft 50 is fitted to be rotatable around the shaft inside the container body 30. The stirring blade 51 is secured to the stir rotation shaft 50.

The stir rotation shaft 50 is, for example, formed in a bar shape long in the front-rear direction with a synthetic resin material. A front end portion of the stir rotation shaft 50 is rotatably fitted in the stir bearing portion 44. A rear-end portion of the stir rotation shaft 50 is connected to a stir connecting member 52 that passes through the stir supporting hole 46. Consequently, the stirring member 32 (the stir rotation shaft 50) is installed between the pair of sidewalls 43Fr and 43Rr opposed across the storage space SP in the upper portion of the stir concave portion 42A.

The stirring blade 51 is, for example, formed of a synthetic-resin film having flexibility. The stirring blade 51 is formed in a rectangular shape with a length approximately identical to the stir rotation shaft 50, and its one side in a longitudinal direction is secured to the stir rotation shaft 50. A size in a radial direction of the stirring blade 51 is set to be longer than a distance connecting a shaft center of the stir rotation shaft 50 and an inner surface of the stir concave portion 42A (see FIG. 3). In the stirring blade 51, a plurality of slits 51A are formed from a free end toward the stir rotation shaft 50 side (see FIG. 4).

As illustrated in FIG. 4, the rear-end portion of the stir rotation shaft 50 is supported by the rear-side sidewall 43Rr via the stir connecting member 52. The stir connecting member 52 includes a stir connecting shaft 52B axially extending from a shaft center of a stir gear 52A. The stir gear 52A is, what is called, a spur gear and receives a transmission of a driving power from a drive motor 64 located inside the apparatus main body 2. The stir connecting shaft 52B is inserted into the stir supporting hole 46 of the sidewall 43Rr from rearward and is rotatably supported by the stir supporting hole 46. A distal end portion of the stir connecting shaft 52B is unrotatably fitted into the rear-end portion of the stir rotation shaft 50.

Configuration of Transport Screw

As illustrated in FIGS. 3 and 4, the transport screw 33 includes a conveyance rotation shaft 60, a spiral blade 61, and a reverse spiral blade 62. The conveyance rotation shaft 60 is supported to be rotatable around the shaft inside the container body 30. The spiral blade 61 and the reverse spiral blade 62 are located on a circumference surface of the conveyance rotation shaft 60. The conveyance rotation shaft 60 and the respective spiral blades 61 and 62 are, for example, integrally formed of a synthetic resin material.

As illustrated in FIG. 4, the conveyance rotation shaft 60 is formed in a bar shape long in the front-rear direction. A front end portion of the conveyance rotation shaft 60 is rotatably supported by the conveyance bearing portion 45. A fitted shaft portion 60A is integrally formed at a rear-end portion of the conveyance rotation shaft 60. The fitted shaft portion 60A has a shaft center identical to that of the conveyance rotation shaft 60 and is formed in an approximately cylindrical shape thicker than the conveyance rotation shaft 60. The fitted shaft portion 60A is connected to a conveyance connecting member 63 that passes through the conveyance supporting hole 47. Consequently, the transport screw 33 (the conveyance rotation shaft 60) is installed between the pair of front and rear sidewalls 43Fr and 43Rr in the upper portion of the conveyance concave portion 42B. The fitted shaft portion 60A is located above the discharge port 30A.

The spiral blade 61 projects from the circumference surface of the conveyance rotation shaft 60 in the radial direction and is formed in a spiral pattern along the axial direction of the conveyance rotation shaft 60. An outer diameter of the spiral blade 61 is formed to be slightly smaller than an inner diameter of a cylinder configured of the conveyance concave portion 42B and the tubular portion 42C.

The reverse spiral blade 62 projects from the circumference surface of the fitted shaft portion 60A in the radial direction and is formed in a spiral pattern of one to two turns. The reverse spiral blade 62 is located on a downstream side (rear side) with respect to the discharge port 30A. The reverse spiral blade 62 has a spiral direction opposite (opposite phase) to that of the spiral blade 61 and is formed with a diameter (outer diameter) identical to that of the spiral blade 61. Since the fitted shaft portion 60A has a diameter larger than the conveyance rotation shaft 60, a toner conveying force of the reverse spiral blade 62 becomes smaller than the toner conveying force of the spiral blade 61.

The rear-end portion (the fitted shaft portion 60A) of the conveyance rotation shaft 60 is supported by the rear-side sidewall 43Rr via the conveyance connecting member 63. The conveyance connecting member 63 includes a conveyance connecting shaft 63B axially extending from a shaft center of a conveyance gear 63A. The conveyance gear 63A (a connecting gear) is, what is called, a spur gear located on a shaft center identical to that of the conveyance connecting shaft 63B, and is connected to the drive motor 64 via a gear train or similar gear row (not illustrated). The conveyance gear 63A engages with the stir gear 52A via an intermediate gear 63C. The conveyance connecting shaft 63B is inserted into the conveyance supporting hole 47 of the sidewall 43Rr from the rearward and rotatably supported by the conveyance supporting hole 47. A distal end portion of the conveyance connecting shaft 63B is unrotatably fitted into the fitted shaft portion 60A.

Action of Toner Container

When the toner is consumed by an image formation process, a control unit of the color printer 1 drivingly controls the drive motor 64 to execute a replenishment operation of the toner. The driving power of the drive motor 64 rotates the conveyance gear 63A (the conveyance connecting member 63) and also rotates the stir gear 52A (the stir connecting member 52) via the intermediate gear 63C. Then, the stirring member 32 and the transport screw 33 also rotate. The stirring blade 51 of the stirring member 32 stirs the toner inside the storage space SP while scraping off the toner that has attached on the inner surfaces of the sidewalls 43L and 43R, the stir concave portion 42A, and similar portion. The stirring member 32 extrudes the toner on the stir concave portion 42A toward the conveyance concave portion 42B. The transport screw 33 conveys the toner on the conveyance concave portion 42B to the discharge port 30A. The toner conveyed up to the discharge port 30A is stopped by rotation of the reverse spiral blade 62 and is discharged from the discharge port 30A toward the developing device 22 (see a solid, bold arrow in FIG. 4). The tubular portion 42C restricts a toner amount conveyed above the discharge port 30A by covering the discharge port 30A. This maintains the toner amount, which is discharged from the discharge port 30A, approximately constant and ensures prevention of excessive replenishment of the toner.

Now, for example, when the toner container 10 is erroneously dropped on a floor surface, there is possibility that the conveyance rotation shaft 60 is significantly warped (bent) by an impact of the drop and its front end portion comes off from the conveyance bearing portion 45. If the front end portion of the conveyance rotation shaft 60 were formed long enough to pass through the sidewall 43Fr, this would ensure the reduced coming-off of the conveyance rotation shaft 60. However, the longer conveyance rotation shaft 60 causes a problem such as enlargement of the toner container 10 or a difficult assembly work of the transport screw 33 to occur. Therefore, the toner container 10 according to the embodiment includes a position regulating portion 34 that reduces the coming-off of the transport screw 33 and ensures facilitated assembly of the transport screw 33.

Figure 5:
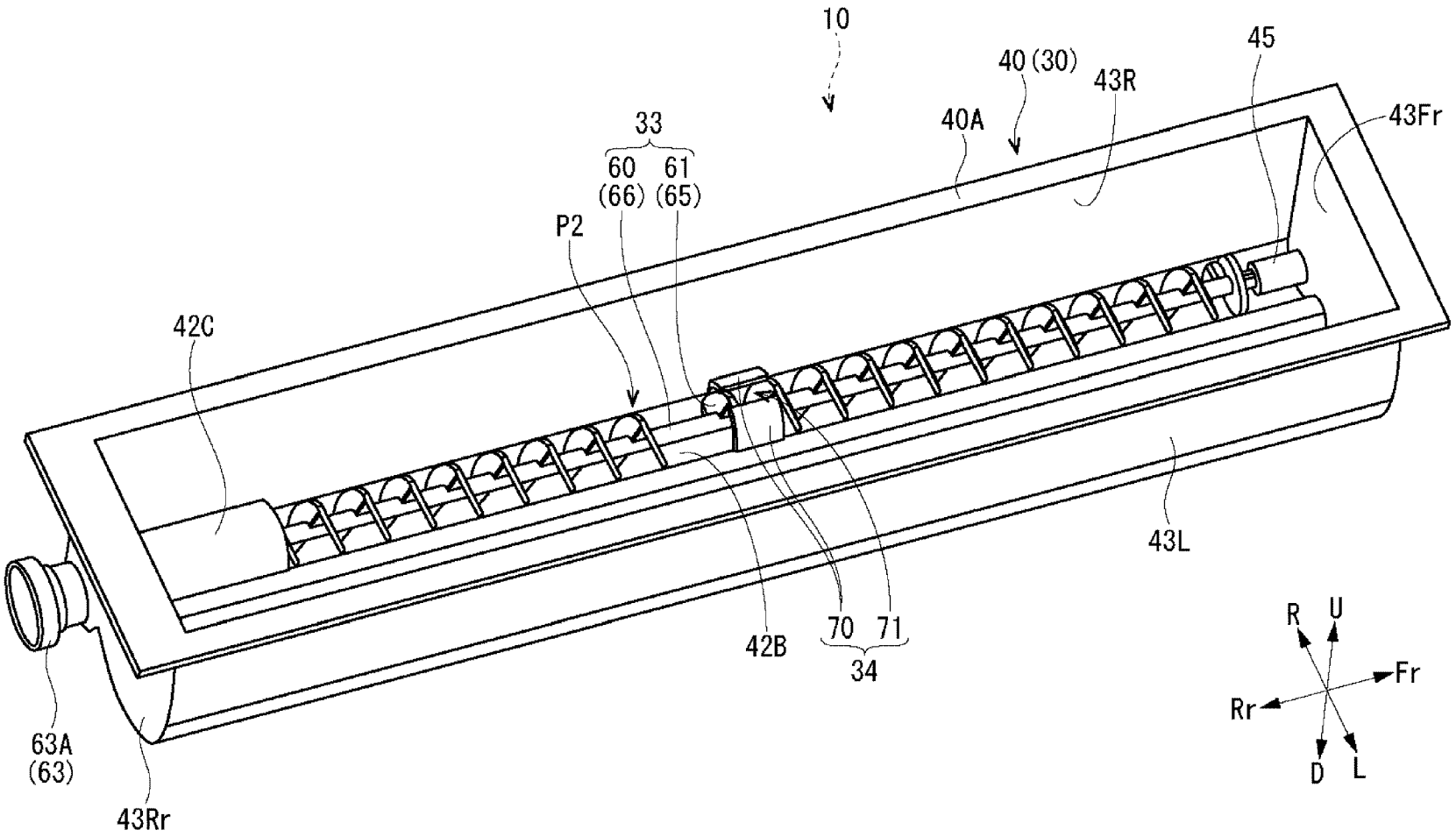
FIG. 5 obliquely illustrates a storage unit and similar component of the toner container according to the one embodiment.
Figure 6:
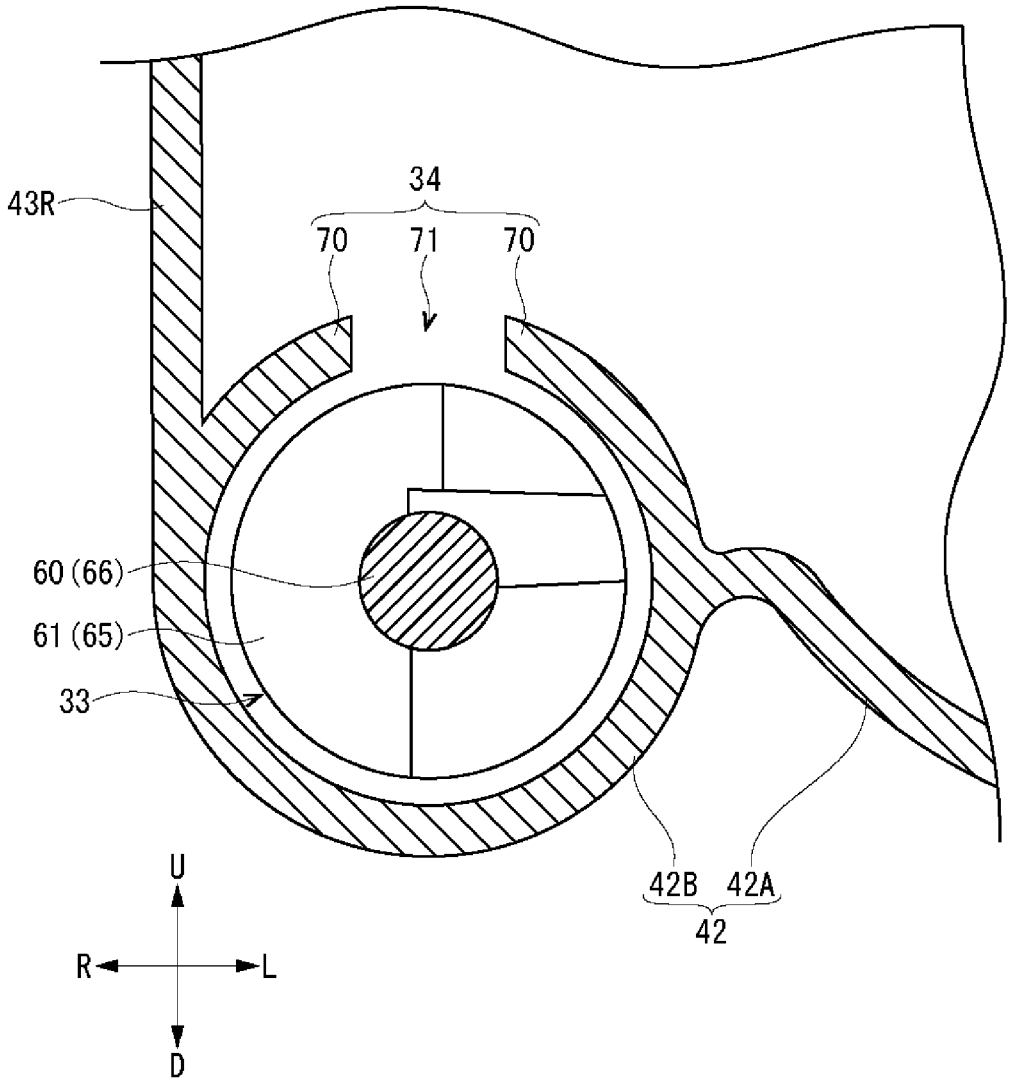
FIG. 6 illustrates a cross-sectional view illustrating a transport screw, a position regulating portion and similar component of the toner container according to the one embodiment.

By referring to FIGS. 5 and 6, a description will be given of the position regulating portion 34, and the transport screw 33 and similar component covered by the position regulating portion 34. FIG. 5 obliquely illustrates the storage unit 40 and similar component of the toner container 10. FIG. 6 illustrates a cross-sectional view illustrating the transport screw 33, the position regulating portion 34, and similar component of the toner container 10.

Large-Diameter Portion and Small-Diameter Portion

Prior to a detail description of the position regulating portion 34, a description will be further given of the configuration of the transport screw 33. As illustrated in FIG. 5, the transport screw 33 has a large-diameter portion 65 and a small-diameter portion 66, which is formed with an outer diameter smaller than that of the large-diameter portion 65. The large-diameter portion 65 is a portion configured by securing the spiral blade 61 (the reverse spiral blade 62) to the circumference surface of the conveyance rotation shaft 60 (the fitted shaft portion 60A). The small-diameter portion 66 is a portion configured of a part of the conveyance rotation shaft 60. In other words, the small-diameter portion 66 is configured of the conveyance rotation shaft 60 by omitting a part of the spiral blade 61. The small-diameter portion 66 is formed at an approximately center in the front-rear direction (the axial direction) of the transport screw 33. That is, the large-diameter portion 65 means the approximately whole of the transport screw 33 except the small-diameter portion 66.

Configuration of Position Regulating Portion

As illustrated in FIGS. 5 and 6, the position regulating portion 34 is located inside the container body 30 so as to cover a part of the transport screw 33. The position regulating portion 34 is located at an approximately center in the front-rear direction of the conveyance concave portion 42B of the container body 30. The position regulating portion 34 includes a pair of regulating pieces 70 that extends from the inner surface of the conveyance concave portion 42B so as to surround the transport screw 33. The pair of regulating pieces 70 is integrally formed with the conveyance concave portion 42B using a material identical to the conveyance concave portion 42B (the storage unit 40). The pair of regulating pieces 70 is a plate-shaped member located upright at the conveyance concave portion 42B so as to be laterally symmetrical. The pair of regulating pieces 70 are curved so as to approach one another upward from the conveyance concave portion 42B. The pair of regulating pieces 70 generally configures an approximately half-cylinder, and an inner diameter of the approximately cylinder configured by the conveyance concave portion 42B and the pair of regulating pieces 70 is formed to be slightly larger than the outer diameter of the spiral blade 61. That is, the above-described large-diameter portion 65 is formed to have the outer diameter rotatable around the shaft inside the position regulating portion 34. A lower portion of the right-side regulating piece 70 is integrated with the right-side sidewall 43R.

The position regulating portion 34 (the pair of regulating pieces 70) is formed to be shorter than the small-diameter portion 66 in the front-rear direction. The position regulating portion 34 is formed to be slightly longer in the front-rear direction than an interval (one pitch) of the spiral blade 61 adjacent to the front-rear direction of the large-diameter portion 65. The position regulating portion 34 may be formed to be shorter than the small-diameter portion 66 and to be equal to or more than one pitch of the spiral blade 61. The small-diameter portion 66 is formed in a length of about 1.5 pitch of the spiral blade 61.

The position regulating portion 34 includes a cut-out portion 71 that regulates passing of the large-diameter portion 65 and permits the passing of the small-diameter portion 66. Specifically, the cut-out portion 71 is configured between the distal ends of the pair of regulating pieces 70. The cut-out portion 71 is formed at an uppermost portion of the pair of regulating pieces 70, which configures an approximately half-cylinder. A lateral width (the interval of the distal ends of the pair of regulating pieces 70) of the cut-out portion 71 is formed to be equal to or more than a diameter of the small-diameter portion 66 (the conveyance rotation shaft 60).

Assembly of Transport Screw

Figure 7:
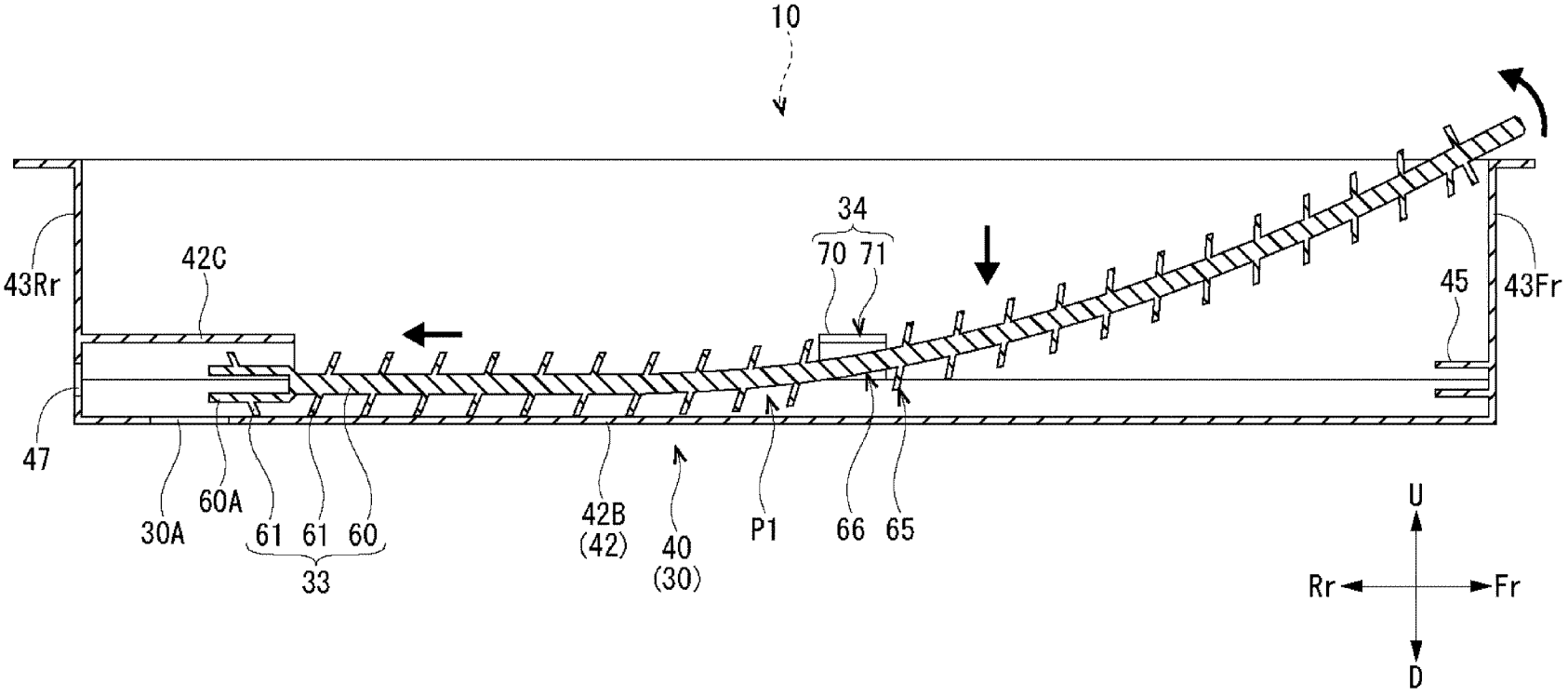
FIG. 7 illustrates a cross-sectional view illustrating a state where the transport screw of the toner container according to the one embodiment is arranged at an attachment/detachment position.
Figure 8:
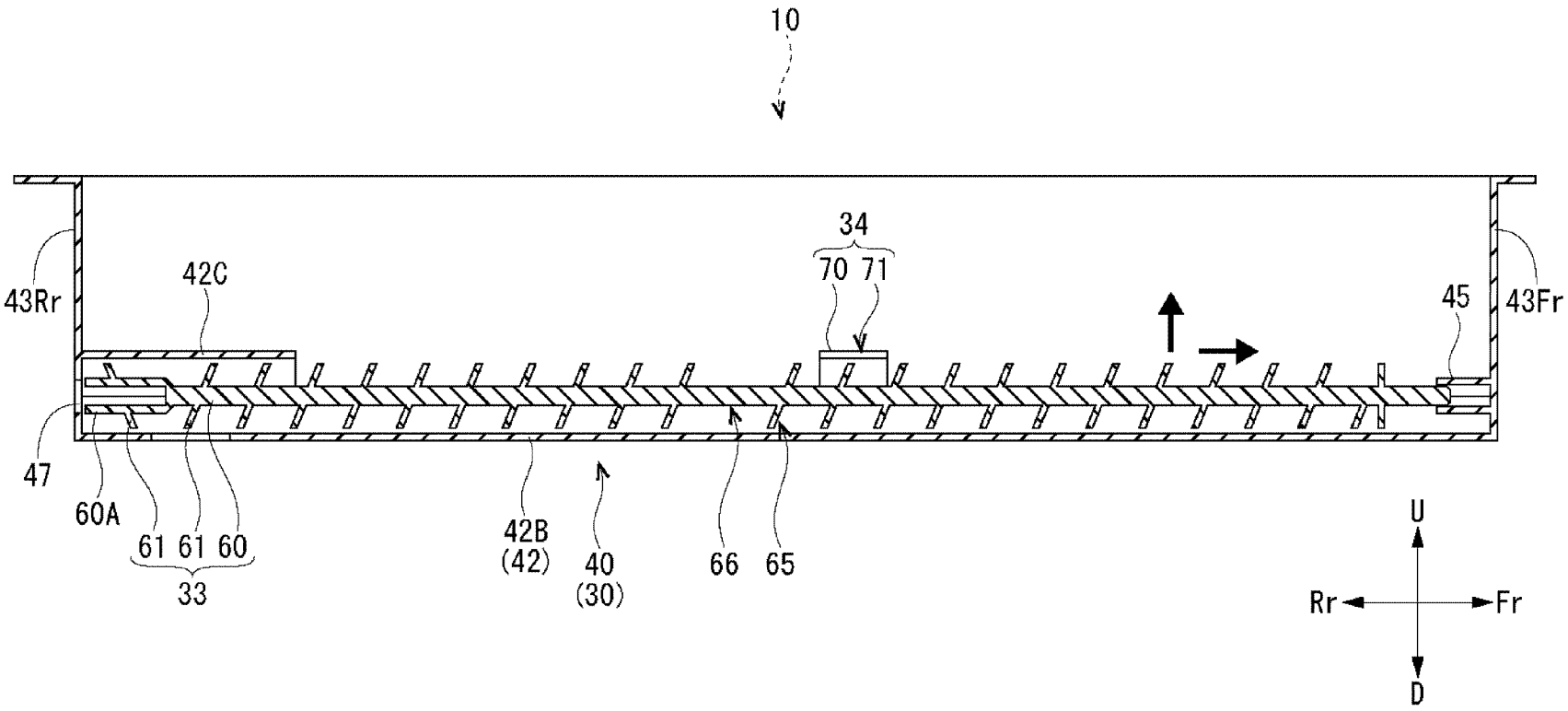
FIG. 8 illustrates a cross-sectional view illustrating an assembly process of the transport screw of the toner container according to the one embodiment.
Figure 9:
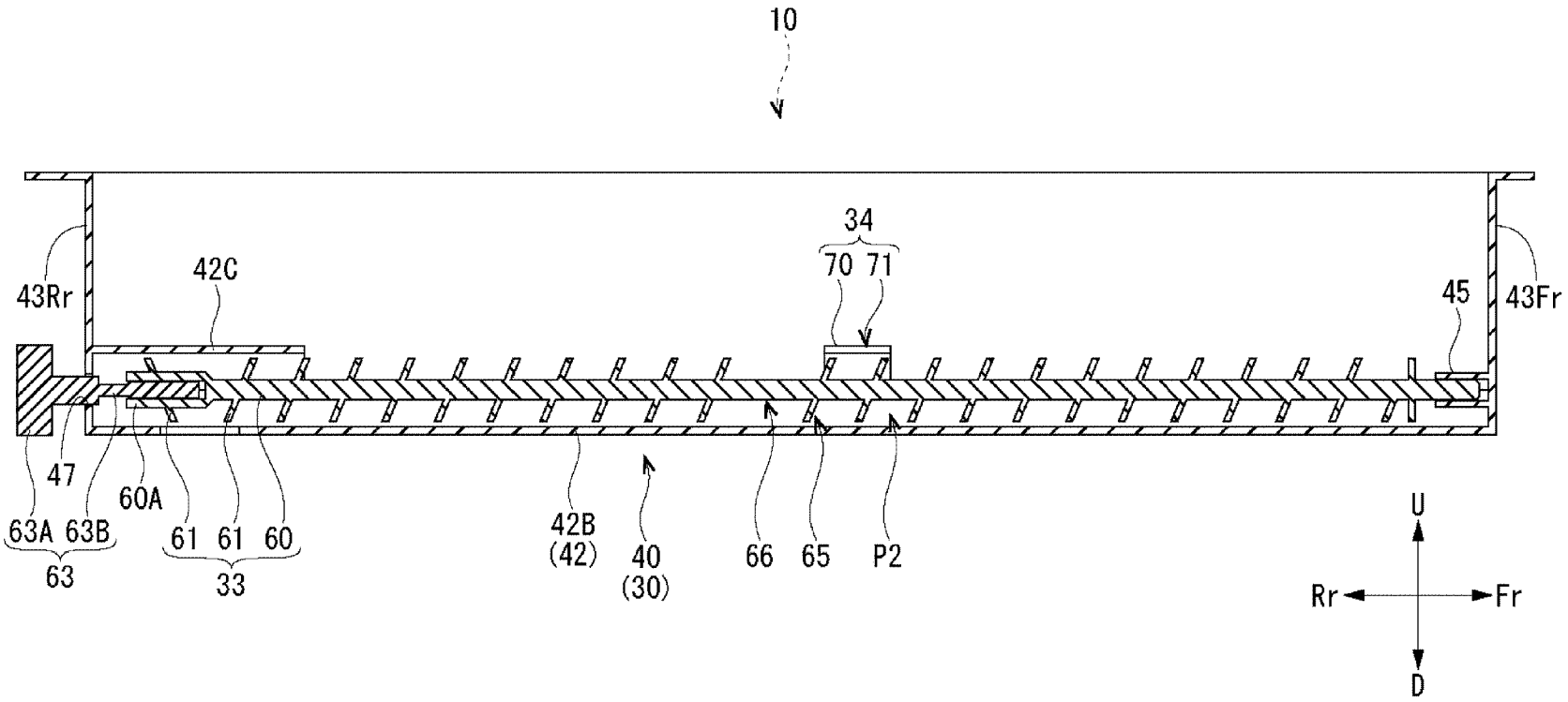
FIG. 9 illustrates a cross-sectional view illustrating a state where the transport screw of the toner container according to the one embodiment is arranged at a support position.

Next, by referring to FIGS. 7 to 9, a description will be given of a procedure to install the transport screw 33 to the container body 30 (the storage unit 40). FIG. 7 illustrates a cross-sectional view illustrating a state where the transport screw 33 is arranged at an attachment/detachment position P1. FIG. 8 illustrates a cross-sectional view illustrating an assembly process of the transport screw 33. FIG. 9 illustrates a cross-sectional view illustrating a state where the transport screw 33 is arranged at a support position P2.

As illustrated in FIG. 7, with the transport screw 33 significantly warped so as to become convex downward, a worker inserts it into the inside of the storage unit 40, and then inserts the rear-end portion of the transport screw 33 into the lower side (between the conveyance concave portion 42B and the tubular portion 42C) of the tubular portion 42C. Subsequently, with the transport screw 33 is warped, the worker causes the small-diameter portion 66 to enter the inside of the position regulating portion 34 (the pair of regulating pieces 70) from the cut-out portion 71 of the position regulating portion 34. Then, with both the end portions of the front and rear are separated from the pair of the sidewalls 43Fr and 43Rr, the transport screw 33 is displaced to the attachment/detachment position P1 where the small-diameter portion 66 that has passed through the cut-out portion 71 is arranged inside the position regulating portion 34. By being displaced to the attachment/detachment position P1, the transport screw 33 can enter the inside of the position regulating portion 34 or separate from the inside of the position regulating portion 34.

Next, as illustrated in FIG. 8, the worker slides the transport screw 33 rearward until the rear-end portion of the conveyance rotation shaft 60 is brought in contact with the sidewall 43Rr. Subsequently, the worker warps the transport screw 33, which is located in front with respect to the position regulating portion 34, so as to become convex upward and causes the front end portion of the conveyance rotation shaft 60 to fit into the conveyance bearing portion 45. In this state, the small-diameter portion 66 is arranged rearward with respect to the position regulating portion 34, and the large-diameter portion 65 is arranged inside the position regulating portion 34.

Next, as illustrated in FIG. 9, the worker inserts the conveyance connecting shaft 63B of the conveyance connecting member 63 into the conveyance supporting hole 47 of the sidewall 43Rr to cause the conveyance connecting shaft 63B to fit into the fitted shaft portion 60A. In this state, both the end portions of the front and rear of the transport screw 33 (the conveyance rotation shaft 60) are rotatably supported by the pair of sidewalls 43Fr and 43Rr. With warped to cause the pair of sidewalls 43Fr and 43Rr to support both the end portions of the front and rear, the transport screw 33 is displaced to the support position P2, where the small-diameter portion 66 is shifted rearward (the axial direction) from the inside of the position regulating portion 34 to arrange the large-diameter portion 65 inside the position regulating portion 34. As described above, the assembly work of the transport screw 33 relative to the container body 30 (the storage unit 40) is completed.

After assembling the transport screw 33, the worker installs the stirring member 32 to the storage unit 40. After fitting the front end portion of the stir rotation shaft 50 into the stir bearing portion 44, the worker causes the stir connecting member 52 (the stir connecting shaft 52B), which is inserted into the stir supporting hole 46 of the sidewall 43Rr, to fit into the rear-end portion of the stir rotation shaft 50 (see FIG. 4). In this state, the stirring member 32 is rotatably supported by the pair of sidewalls 43Fr and 43Rr. Subsequently, the lid portion 41 (the lid-side flange 41A) is joined to the storage unit 40 (the flange 40A) and the assembly of the toner container 10 is completed. The toner is filled into the storage space SP from a filling port (not illustrated) formed in the toner container 10.

In the above-described toner container 10 according to the embodiment, the transport screw 33 is movably located between the attachment/detachment position P1 and the support position P2. That is, the toner container 10 is configured such that after causing the small-diameter portion 66 of the transport screw 33 to enter the cut-out portion 71 of the position regulating portion 34, causing the pair of sidewalls 43Fr and 43Rr to support both the end portions of the transport screw 33 by warping the transport screw 33 moves the large-diameter portion 65 of the transport screw 33 to the inside of the position regulating portion 34. Since the large-diameter portion 65 has an outer diameter that cannot pass through the cut-out portion 71, when being warped (bent) by an external impact (for example, when the toner container 10 drops) or similar impact, the transport screw 33 is brought in contact with the inner surface of the position regulating portion 34 (the respective regulating pieces 70), and the large warp is regulated. Consequently, even when a large impact is applied to the toner container 10, the transport screw 33 is not significantly warped and is held inside the position regulating portion 34 (the support position P2). This ensures the reduced coming-off of the front end portion of the transport screw 33 from the sidewall 43Fr due to the warp of the transport screw 33. Then, this ensures maintaining a state of causing the pair of sidewalls 43Fr and 43Rr to support both the end portions of the transport screw 33.

It is only necessary that the transport screw 33 is formed to have a length that can span the pair of sidewalls 43Fr and 43Rr because the position regulating portion 34 regulates the warp of the transport screw 33. This ensures reduced unnecessary extension of the transport screw 33 and thus ensures facilitated assembly of the transport screw 33 to the container body 30 (the storage unit 40).

In the toner container 10 according to the embodiment, the small-diameter portion 66 is formed by removing a part of the spiral blade 61 of the transport screw 33. This ensures a simple and low-cost configuration of the transport screw 33 with the small-diameter portion 66 based on an existing screw. Since the spiral blade 61 does not exist at the small-diameter portion 66, a conveying capability of the toner is slightly reduced at the small-diameter portion 66. However, since the length of the small-diameter portion 66 is considerably small compared with the whole transport screw 33, the necessary and sufficient conveying capability of the toner is secured.

In the toner container 10 according to the embodiment, the position regulating portion 34 is formed to have a length in the axial direction longer than one pitch of the spiral blade 61 of the large-diameter portion 65. With this configuration, the spiral blade 61 is brought into contact with the inner surface of the position regulating portion 34 when the transport screw 33 arranged at the support position P2 is warped. This ensures appropriate regulation of the warp of the transport screw 33 and ensures holding of the transport screw 33 at the support position P2.

With the toner container 10 according to the embodiment, integrally forming the respective regulating pieces 70 with the container body 30 ensures reduced production cost of the container body 30 and the position regulating portion 34, compared with forming the position regulating portion 34 (the respective regulating pieces 70) using a separate member.

In the toner container 10 according to the embodiment, the position regulating portion 34 is located in the front-rear-direction (axial-direction) center where an amount of displacement in a radial direction of the transport screw 33 becomes maximum. This configuration ensures effectively reducing the warp of the transport screw 33 by the position regulating portion 34 and ensuring a necessary warp amount of the transport screw 33 during assembly of the transport screw 33. As described above, while it is preferred that the small-diameter portion 66 be formed in the proximity of the front-rear-direction center of the transport screw 33, a forming position of the small-diameter portion 66 may be displaced forward or rearward from the front-rear-direction center of the transport screw 33.

Furthermore, the toner container 10 according to the embodiment can cause the sidewall 43Rr to support the rear-end portion of the transport screw 33 via the conveyance connecting member 63 after causing the conveyance bearing portion 45 to support the front end portion of the transport screw 33. Thus, the toner container 10 includes the conveyance bearing portion 45, which is located at any one of the pair of sidewalls 43Fr and 43Rr and rotatably supports one end portion in the axial direction of the transport screw 33, and the conveyance connecting member 63, which is rotatably mounted to any other one of the pair of sidewalls 43Fr and 43Rr and is connected to the other end portion in the axial direction of the transport screw 33. This ensures simple and quick assembly of the transport screw 33 to the storage unit 40.

In the toner container 10 according to the embodiment, while the cut-out portion 71 of the position regulating portion 34 is formed to be equal to or more than the diameter of the small-diameter portion 66, the disclosure is not limited to this. Because the respective regulating pieces 70, which are made of synthetic resin, are elastically deformed in the lateral direction with a base end portion as a fulcrum, elastically deforming the pair of the regulating pieces 70 so as to separate from one another ensures causing the small-diameter portion 66 to pass through the pair of the regulating pieces 70. Consequently, in a state (a normal state) where the respective regulating pieces 70 are not elastically deformed, a width of the cut-out portion 71 may be formed to be smaller than the outer diameter of the small-diameter portion 66. This further ensures a reduced risk of coming-off of the transport screw 33 from the position regulating portion 34.

First Modification

Figure 10:
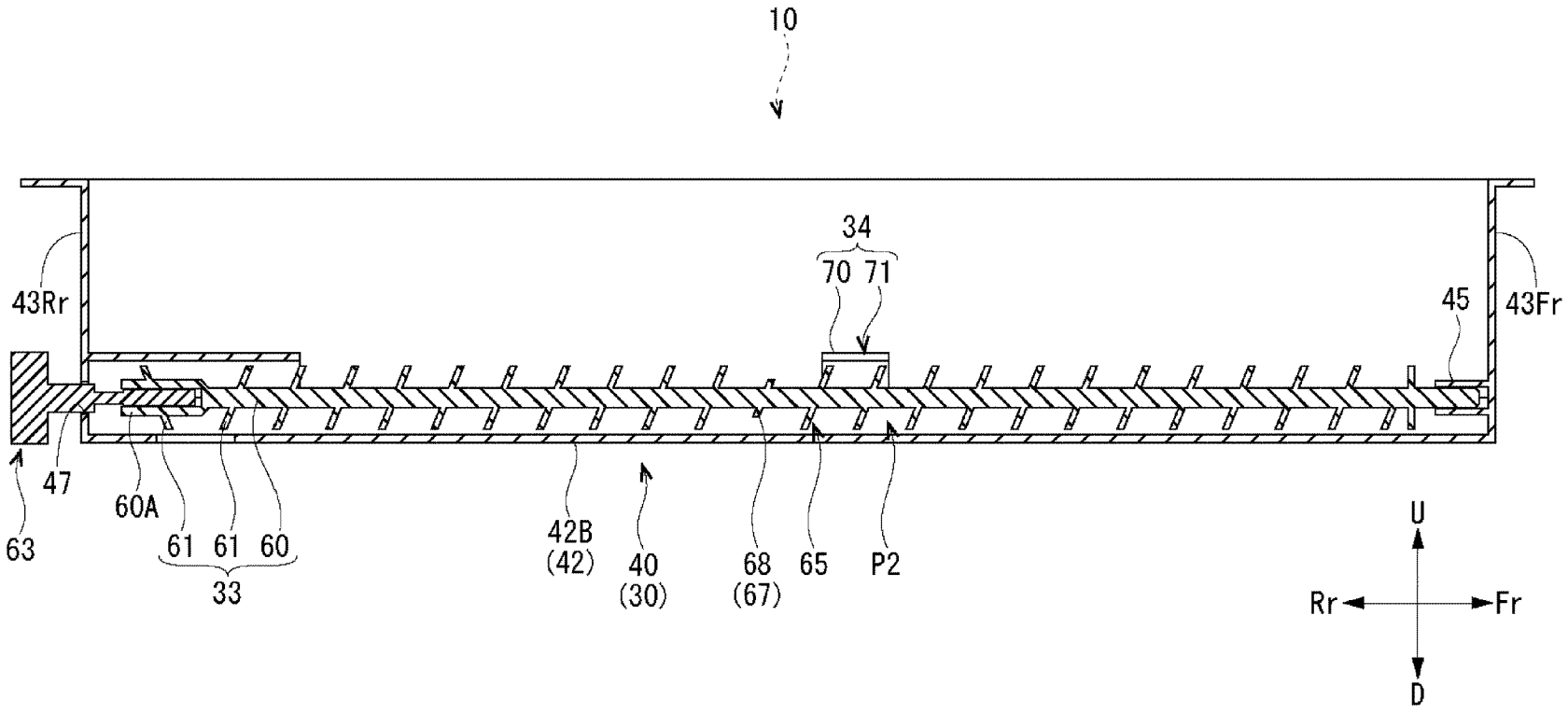
FIG. 10 illustrates a cross-sectional view illustrating a transport screw of a toner container according to a first modification of the one embodiment.

While in the above-described toner container 10, the small-diameter portion 66 is configured by omitting a part of the spiral blade 61, the disclosure is not limited to this. For example, as illustrated in FIG. 10, in a toner container 10 according to the first modification, a small-diameter portion 67 may be configured by securing a spiral-patterned small-diameter blade 68 having an outer diameter smaller than that of the spiral blade 61 at a part of the circumference surface of the conveyance rotation shaft 60. In this case, the cut-out portion 71 of the position regulating portion 34 is formed so as to permit passing of the small-diameter blade 68. As described above, since the small-diameter portion 67 has the small-diameter blade 68 that conveys the toner, this ensures the reduced reduction of the conveying force of the toner compared to when the small-diameter portion 66 is the conveyance rotation shaft 60.

Second to Fourth Modifications

Figure 11:
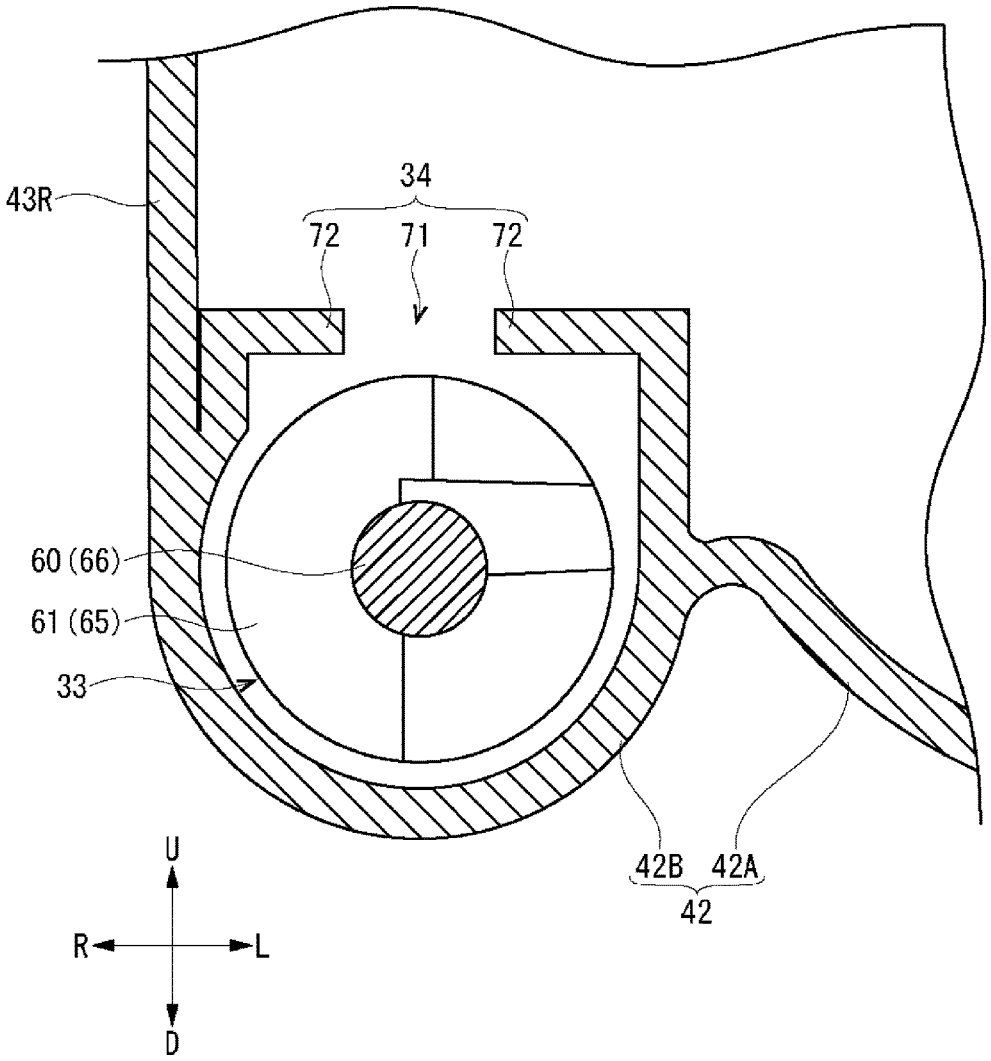
FIG. 11 illustrates a cross-sectional view illustrating a position regulating portion and similar portion of a toner container according to a second modification of the one embodiment.
Figure 12:
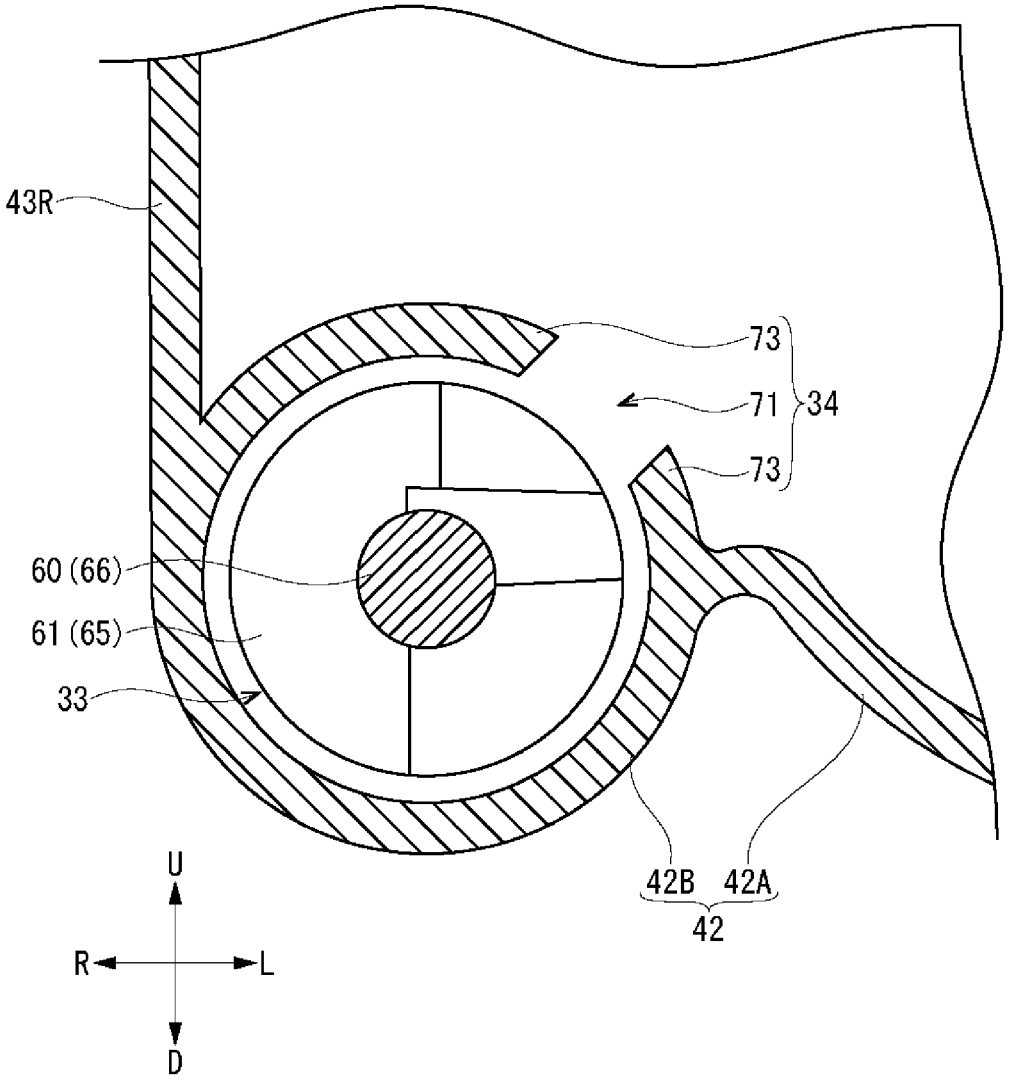
FIG. 12 illustrates a cross-sectional view illustrating a position regulating portion and similar portion of a toner container according to a third modification of the one embodiment.
Figure 13:
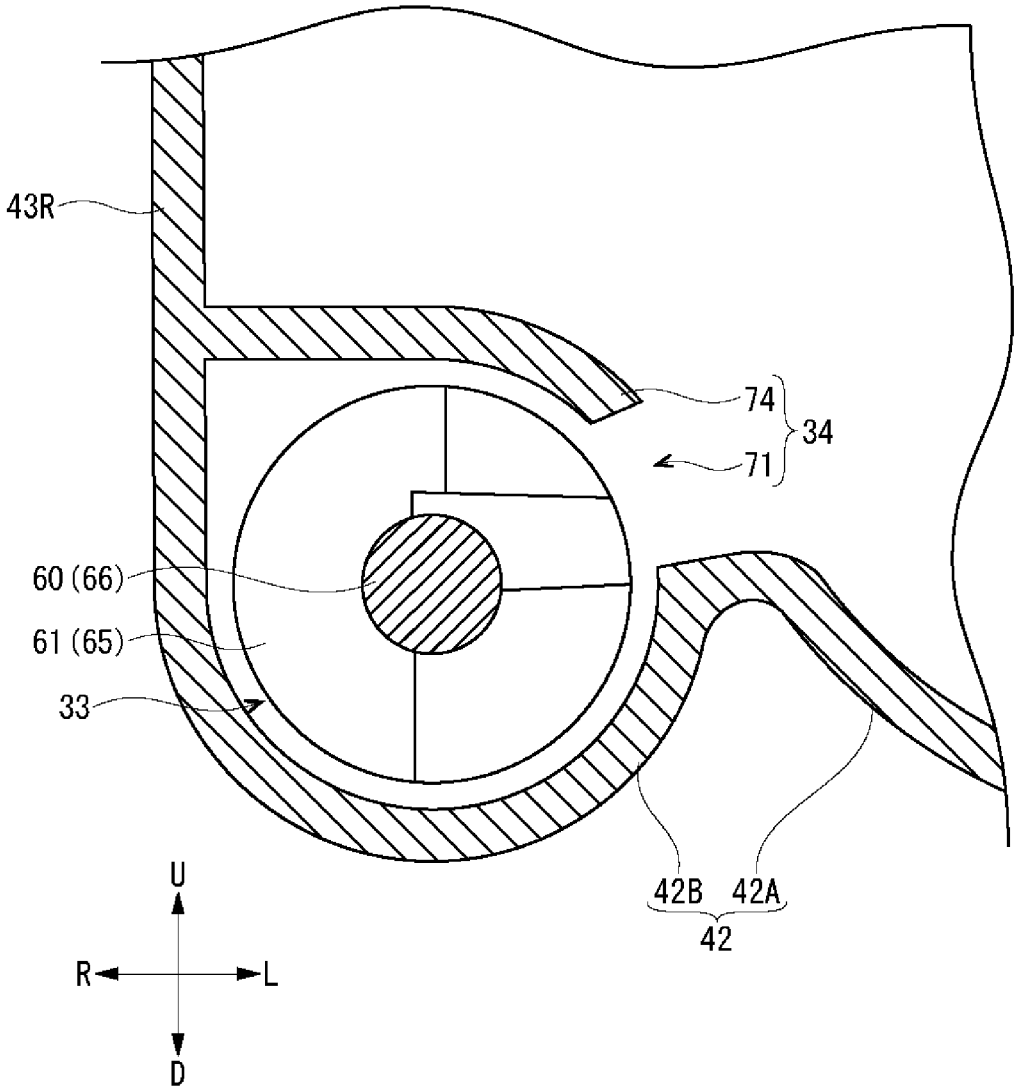
FIG. 13 illustrates a cross-sectional view illustrating a position regulating portion and similar portion of a toner container according to a fourth modification of the one embodiment.

While in the toner container 10 according to the embodiment (including the first modification), the pair of regulating pieces 70 of the position regulating portion 34 is curved to be laterally symmetrical, the disclosure is not limited to this. For example, as illustrated in FIG. 11, a pair of regulating pieces 72 may have upper end portions, which extend upward from the conveyance concave portion 42B and are bent so as to approach to one another (the second modification). For example, as illustrated in FIG. 12, a pair of regulating pieces 73 may be formed so as to be laterally asymmetrical, and the cut-out portion 71 may be formed on the left side (the third modification). Further, as illustrated in FIG. 13, one regulating piece 74 may be formed extending so as to be curved to a lower left side from the sidewall 43R (the fourth modification). In this case, the cut-out portion 71 is configured between a distal end of the regulating piece 74 and the conveyance concave portion 42B.

Fifth Modification

Figure 14:
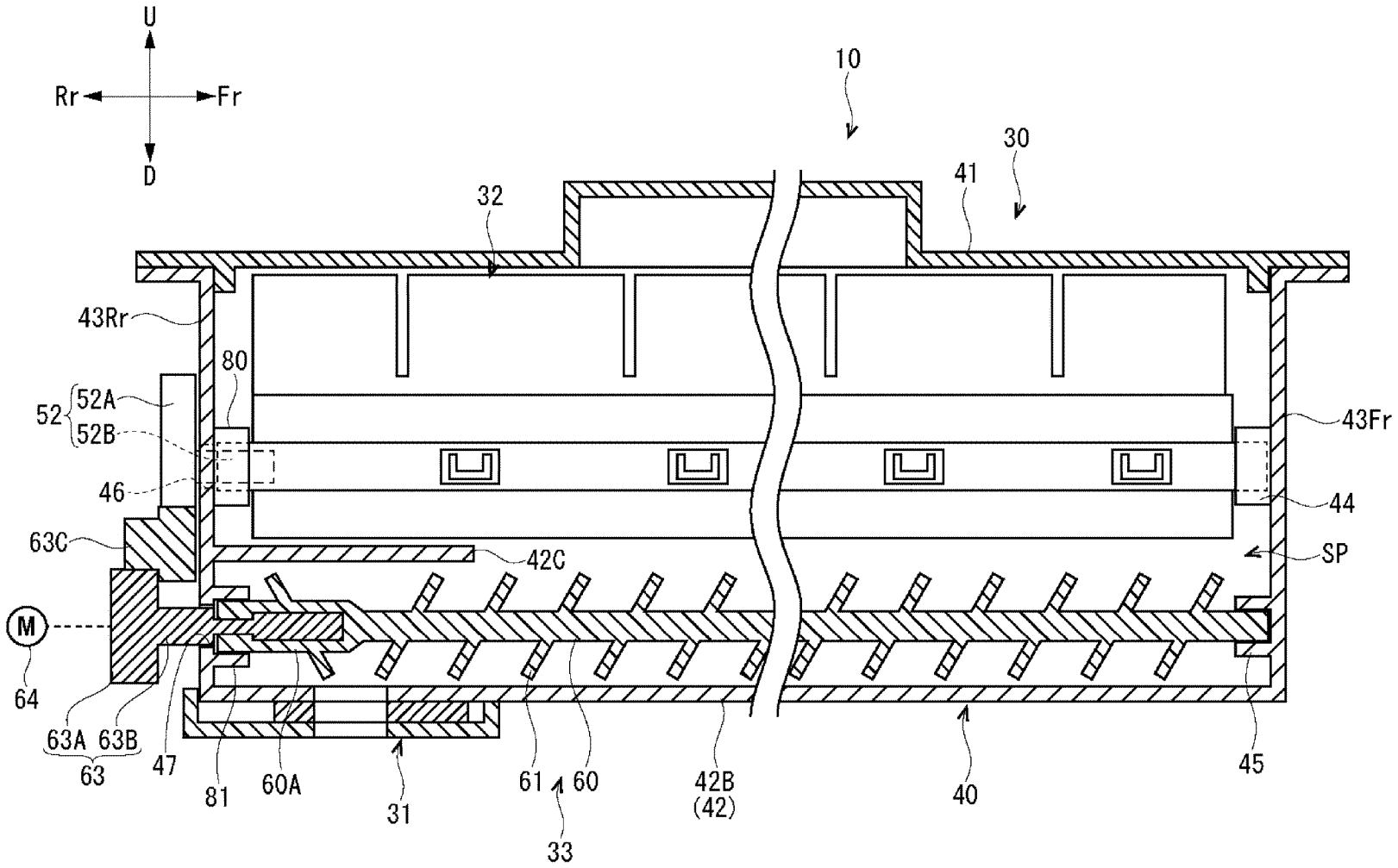
FIG. 14 illustrates a cross-sectional view illustrating a toner container according to a fifth modification of the one embodiment.

While in the toner container 10 according to the embodiment (including the respective modifications, and the same applies to the following), the stirring member 32 or a bearing portion into which the rear-end portion of the transport screw 33 is fitted does not exist on the rear-side sidewall 43Rr, the disclosure is not limited to this. As illustrated in FIG. 14, bearing portions 80 and 81 that rotatably support the rear-end portion of the transport screw 33 or similar screw may be located on the sidewall 43Rr. In this case, it is preferred that the respective bearing portions 80 and 81 be formed in peripheral edge portions of the respective supporting holes 46 and 47. In this case, in the assembly work of the transport screw 33, a worker passes the small-diameter portion 66 through the cut-out portion 71 of the position regulating portion 34 to fit the rear-end portion of the transport screw 33 into the bearing portion 81. Consequently, the transport screw 33 is displaced to the attachment/detachment position P1, where the small-diameter portion 66 is arranged inside the position regulating portion 34, in a state where its front end portion is separated from the sidewall 43Fr. Then, the worker warps the transport screw 33 to fit its front end portion into the conveyance bearing portion 45, and moves the transport screw 33 to the support position P2. The stirring member 32 is also assembled to the storage unit 40 in a procedure approximately similar to the assembly of the transport screw 33.

While in the toner container 10 according to the embodiment, the stirring member 32 and the rear-end portion of the transport screw 33 are supported by the sidewall 43Rr via the respective connecting members 52 and 63, not limited to this, the front end portion of the transport screw 33 or similar screw may be supported via the conveyance connecting shaft 63B or similar shaft.

While in the toner container 10 according to the embodiment, the position regulating portion 34 reduces the coming-off of the transport screw 33 as one example of a rotating member, not limited to this, the position regulating portion 34 may be configured so as to reduce the coming-off of a member installed over the pair of sidewalls 43Fr and 43Rr, such as the stirring member 32.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A developer container comprising:

a container body that includes an internal space and a pair of sidewalls, the internal space housing a developer, the pair of sidewalls being opposed across the internal space;

a rotating member that includes both end portions in an axial direction of the rotating member, both the end portions being rotatably supported by the pair of sidewalls; and a position regulating portion located in the container body so as to cover a part of the rotating member; wherein the rotating member includes a large-diameter portion formed to have an outer diameter rotatable around a shaft inside the position regulating portion, and a small-diameter portion formed to have an outer diameter smaller than the large-diameter portion;

the position regulating portion includes a cut-out portion that regulates passing of the large-diameter portion and permits passing of the small-diameter portion; and the small-diameter portion is arranged by being displaced in the axial direction from an inside of the position regulating portion, and the large-diameter portion is arranged inside the position regulating portion.

2. The developer container according to claim 1, wherein the rotating member is movably located between an attachment/detachment position and a support position, the attachment/detachment position being a position where the small-diameter portion having passed through the cut-out portion is arranged inside the position regulating portion in a state where at least one of both the end portions in the axial direction is separated from the sidewall, the support position being a position where the small-diameter portion is displaced in the axial direction from the inside of the position regulating portion to arrange the large-diameter portion inside the position regulating portion by warping the rotating member to cause the pair of sidewalls to support both the end portions in the axial direction.

3. The developer container according to claim 1, wherein:

the rotating member is a transport screw that conveys the developer housed in the container body to a discharge port opened in the container body; and the transport screw includes the large-diameter portion that includes a rotation shaft and a spiral-patterned spiral blade secured to a circumference surface of the rotation shaft, and the small-diameter portion configured as a part of the rotation shaft.

4. The developer container according to claim 1, wherein:

the rotating member is a transport screw that conveys the developer housed in the container body to a discharge port opened in the container body; and the transport screw includes the large-diameter portion that includes a rotation shaft and a spiral-patterned spiral blade secured to a circumference surface of the rotation shaft, and the small-diameter portion that includes a spiral-patterned small-diameter blade secured to a part of the circumference surface of the rotation shaft, the spiral-patterned small-diameter blade having an outer diameter smaller than the spiral blade.

5. The developer container according to claim 3, wherein the position regulating portion is formed to be longer in the axial direction than an interval of the spiral blades axially adjacent to the large-diameter portion.

6. The developer container according to claim 1, wherein:

the position regulating portion includes a pair of regulating pieces that extends from an inner surface of the container body so as to surround the rotating member; and the cut-out portion is configured between distal ends of the pair of regulating pieces.

7. The developer container according to claim 1, wherein:

the small-diameter portion is formed in a proximity of an axial-direction center of the rotating member; and the position regulating portion is formed in a proximity of an axial-direction center of the container body.

8. The developer container according to claim 1, comprising:

a bearing portion located at one of the pair of sidewalls, the bearing portion rotatably supporting one end portion in the axial direction of the rotating member; and a connecting member rotatably mounted to the other of the pair of sidewalls, the connecting member being connected to the other end portion in the axial direction of the rotating member; wherein the connecting member includes a connecting shaft unrotatably fitted into the rotating member, and a connecting gear located on a shaft center identical to the shaft center of the connecting shaft, the connecting gear being connected to a driving source that rotates the rotating member.

9. An image forming apparatus comprising the developer container according to claim 1.

* * * * *